US005645099A

United States Patent [19]

Eaton et al.

[11] Patent Number: 5,645,099

[45] Date of Patent: Jul. 8, 1997

[54] SEWER RELIEF VALVE

[75] Inventors: Dean L. Eaton, 950 E. Lehi Rd., Mesa, Ariz. 85203; Michael L. Steele, Mesa, Ariz.

[73] Assignees: Dean L. Eaton; Michael Steele, both of Mesa, Ariz.

[21] Appl. No.: 680,505

[22] Filed: Jul. 8, 1996

[51] Int. Cl.[6] ..... E03F 5/08; F16K 31/22; F16K 33/00

[52] U.S. Cl. ..... 137/15; 4/211; 4/219; 4/295; 4/669; 4/DIG. 7; 137/357

[58] Field of Search ..... 4/211, 219, 293, 4/295, 669, 671, 674, 689; 137/DIG. 7, 192, 202, 356, 357, 430, 433, 533, 533.17, 533.31

[56] References Cited

U.S. PATENT DOCUMENTS

| | | | |
|---|---|---|---|
| 3,161,206 | 12/1964 | Grundmann | 137/433 |
| 3,603,340 | 9/1971 | Rousselet | 137/357 |
| 3,805,826 | 4/1974 | Westerhoff | 137/533 |
| 3,815,629 | 6/1974 | Oberholtzer | 4/211 |
| 3,852,836 | 12/1974 | Oberholtzer | 4/219 |
| 4,114,641 | 9/1978 | Robinson et al. | 137/430 |
| 4,261,386 | 4/1981 | Young | 137/467 |
| 4,475,571 | 10/1984 | Houston, Jr. | 4/211 |
| 4,518,005 | 5/1985 | Allewitz | 137/433 |
| 4,747,540 | 5/1988 | Meyer | 137/433 |
| 4,850,059 | 7/1989 | Dickerson | 4/219 |
| 5,031,659 | 7/1991 | Gonzales | 4/211 |
| 5,209,257 | 5/1993 | Baker | 4/211 |

*Primary Examiner*—George L. Walton

[57] ABSTRACT

A sewer relief valve (40) made out of a durable plastic material comprises: a raised head or float housing (52) that serves as a gripping means during it's removal and installation; said housing (52) has male threads (53) which circumference the lower vertical exterior of said float housing (52); said housing (52) surrounding a central passageway (58) through which a hydrostatic pressure relieving float (54) may pass unobstructed; a cap (50) attached to an upper portion of float (54) effectively sealing said central passageway (58) and cosmetically dressing up said float housing (52) of said sewer relief valve (40) to give it the appearance of a conventional raised head plug (28).

13 Claims, 1 Drawing Sheet

SEWER RELIEF VALVE

BACKGROUND

1. Field of Invention

This invention relates to sewage distribution systems, specifically to an improved sewer relief valve.

2. Description of Prior Art

In the system of sewer pipes connecting residences and buildings with the city sewer line, problems will develop that will cause these lines to become clogged, thereby backing sewage and wastewater until the lines are filled and sewage overflows in the interior of a building. Conventional drain and sewer systems have no means to prevent this overflowing of sewage. This dilemma has motivated the development of a considerable amount of prior art with respect to deterring this overflowing sewage problem. Attempts to incorporate prior art into the conventional sewer system usually involved substituting prior art for the clean out plug of a sewage flow riser tube referred to as a clean out riser. In conventional sewer systems it is common to have at least one clean out riser to provide access to that system for maintenance purposes. The clean out riser is usually disposed vertically, has interior threads at its upper extremity, and is closed by an exteriorly threaded plug. These clean out plugs are manufactured in a variety of designs. One of the more common designs is a plug having extending wall portions generally referred to as a raised head plug, it being available from manufacturers such as Charlotte, Nibco, GSR, or American Brass. Comprising some form of a sewer relief valve that replaces the conventional raised head plug, prior art have made possible a partial solution to the dilemma. Prior art sewer relief valves function to relieve hydrostatic pressure in a sewer line at the clean out riser outside of a structure. The principle of operation behind said valve is, because said valve, installed at a level lower than all plumbing facilities inside a structure, forces sewage and wastewater from a plugged sewer line to discharge through means provided at said valve rather than inside said structure. Thus, no sewage can rise above the level of said valve installed in said conventional riser as it will automatically overflow on to the surrounding areas. As shown, prior art does provide a substantial measure of protection against sewage flooding any structure's interior. The amount of prior art work is somewhat extensive with many patents having been issued for devices which possibly offer solutions, at least in theory, to the sewer backup dilemma. However, no prior art models are readily available to all public or even contractors for installation in the conventional sewer system. As to why no prior art are readily available, the reasons are not obvious or apparent. A careful review of prior art suggests that these models are not appropriate for the following reasons:

(a) Due to technical difficulty and great expense of manufacturing a product, the product must be no more complicated than necessary in order for it to be cost effective. Some prior art are too complicated for the simple purpose that serve, and as a result are too costly and unfeasible for large scale production.

(b) Overly complicated prior art has the effect of making the product too expensive, reducing public demand and consequently public protection.

(c) Complicated prior art increases the level of difficulty of installation and requires professional assistance.

(d) Some prior art models have the disadvantage of obstructing the accessibility of the sewer system for maintenance purposes, such as: U.S. Pat. No. 4,475,571 to Houston, May 1984; and U.S. Pat. No. 4,114,641 to Robinson, September 1978.

(e) Furthermore, weather and age severely inhibit removal of fittings not prepared and designed for occasional removal. As a result, the fitting is often destroyed in the attempt to remove it.

Obviously, even though prior art has been developed and patented, their failure to protect the general public from certain financial and possible health risks as a result of sewage flooding the interior of a building unprotected by a sewer relief valve, demands the need for a new, cost effective and uncomplicated sewer relief valve. This need can be satisfied by the following improved sewer relief valve. This invention utilizes an assembly which replaces only the raised head clean out plug, said assembly having a closure which is adapted to open at a predetermined level of hydrostatic pressure.

OBJECTS AND ADVANTAGES

Accordingly, several objects and advantages of the present invention are:

(a) To provide an uncomplicated valve that has a low technical difficulty and high feasibility for large scale manufacturing.

(b) To provide an inexpensive valve making it more available to a larger population and consequently increasing public protection.

(c) To remove or even eliminate the need for professional assistance during its installation.

(d) To ensure that maintenance accessability to the sewer system is unhindered by the valve.

(e) To integrate features of a raised head plug in the valve that ensure a ready means for easy removal of the valve, despite weather and age.

Further objects and advantages are to provide a valve that will simply change an existing clean out riser with raised head plug to clean out riser with sewer relief valve, thus protecting the interior of a building from flooding damage due to a blocked sewer system.

DRAWING FIGURES

Further objects and advantages will become apparent from a consideration of the appended claims and attached drawings, wherein:

DETAILED DESCRIPTION

Figure 1:
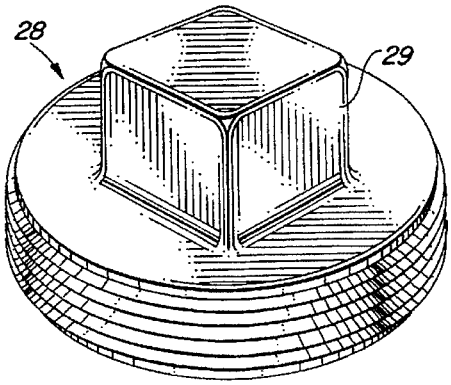
FIG. 1 (PRIOR ART)
FIG. 1 shows a perspective view of a conventional raised head plug.
Figure 2:
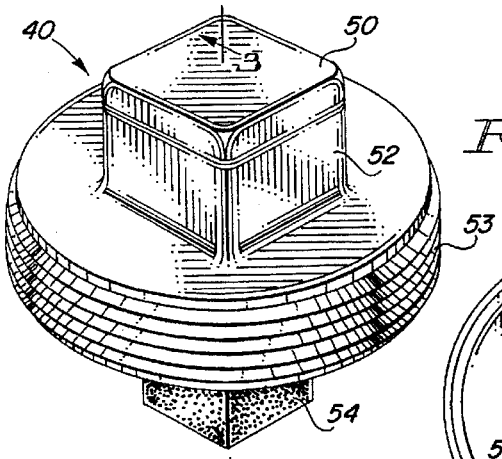
FIG. 2 shows the present invention in a perspective view of the assembled and normally closed position.
Figure 4:
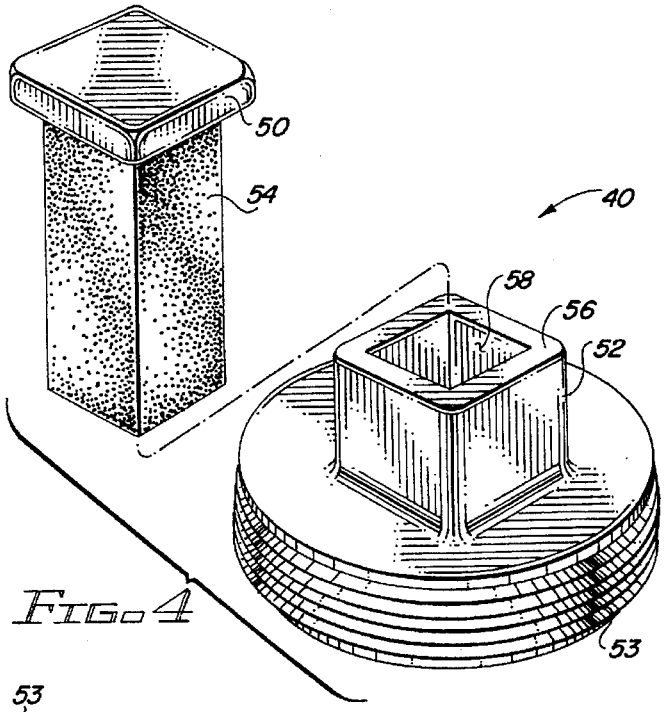
FIG. 4 shows the present invention in a perspective view, the float being removed from the sewage flow riser housing.
Figure 5:
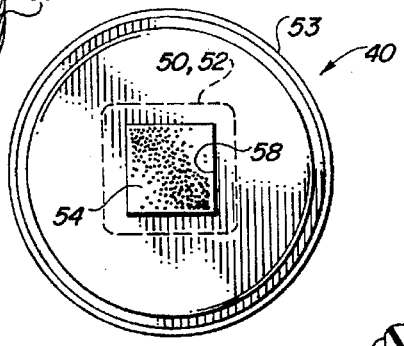
FIG. 5 is a bottom view of the invention as in FIG. 2.
Figure 3:
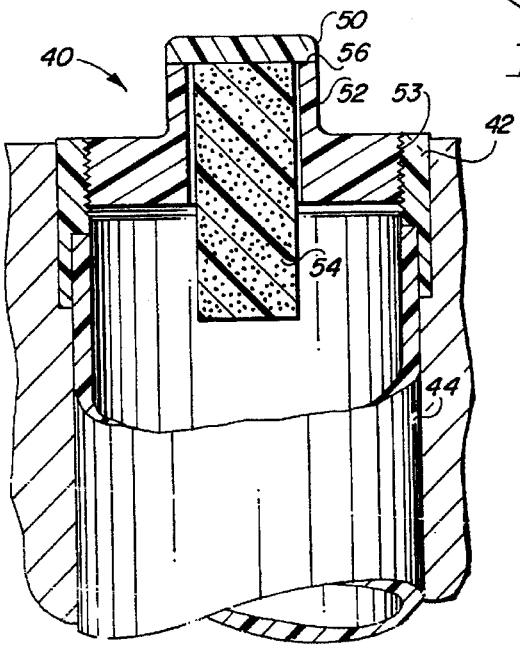
FIG. 3 is a cross sectional view of the assembled sewer relief valve installed in a conventional sewage flow riser tube or otherwise known as a clean out riser.

Referring now in more detail to the drawings, FIG. 1, illustrating a conventional raised head plug 28, and FIG. 2, an improved sewer relief valve 40, have unmistakable similarities. Sewer relief valve 40 is necessarily manufactured of a lightweight substance, one possibility being plastic, and has the outward general appearance of standard plastic raised head plug 28. FIG. 2 and FIG. 3, show that, like raised head plug 28, sewer relief valve 40 has male threads 53, circumferencing the vertical exterior surface thereof, that are manufactured to screw into any receiving threaded clean out adapter 42. However, there are major differences being said plug 28 and said valve 40. In FIG. 4, said valve 40 shows that preferably a portion, labeled as cap 50 of the extreme upper surface of the raised square head, said raised head referred to from now on as floating housing 52, has been sliced off and secured to a float 54 defining a float member. Of course, the cap with float as one piece and float housing as another could be manufactured separately. Continuing on, FIG. 4 shows that removal of said cap 50 and said float 54 from float housing 52, reveals a central passageway or hollow interior aperture 58 in float housing 52, through which float 54 may pass unobstructed as in illustrated in FIG. 3. Said cap 50 is affixed to said float 54 so as to provide means for retaining said float 54 within said aperture 58 of said float housing 52. Positioned in said aperture 58, the bottom surface of said cap 50 mates with upper surfaces 56 of said float housing 52. Composed of extremely buoyant and water-resistant material said float 54, as illustrated by the bottom perspective view in FIG. 5, is a rectangular parallelpiped having dimension tolerances that substantially seal said float 54 and inside walls of float housing 52. Length of float 54 is arbitrary and shall be adjusted for ease of manufacturing.

OPERATIONS

Figure 6:
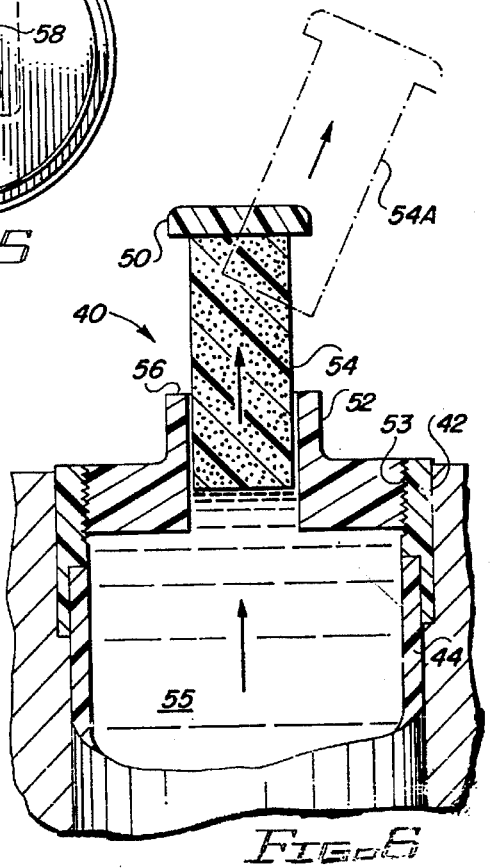
FIG. 6 is similar to FIG. 3 with the exception that sewage has reached the level of the sewer relief valve and opened it by forcing float to eject.

The location and manner of installation of sewer relief valve 40 is identical to raised head plug 28 as shown in FIG. 3. The method of operation, involves cap 50 affixed to float 54 by means of a glue adhesive, and under effects of gravity, is abutted by upper edge 56 of float housing 52. In said position, cap 50 serves to seal sewer relief valve 40 from external debris and effectively seals said central passageway 58 from escapage of sewer gases. In contrast, as is illustrated in FIG. 6, the hydrostatic pressure of sewage 55 rising in riser 44, as a result of plugged conditions, will cause float 54 to rise vertically and completely eject float 54*a*, allowing sewage to discharge continuously during given conditions. Removal of sewer relief valve 40 is required to unplug any blockage. It should be noted that after the obstruction is removed, and sewer relief valve 40 again reinstalled, float 54 need only be reset in central passageway 58 of housing 52, before the valve system of sewer relief valve 40 is once again in normal working conditions. Removal and installation of said valve 40 demonstrates the key features of this invention that distinguish it from other devices of similar purpose. Experience teaches that weather and age have serious deteriorating effects on exposed plastic, causing threads to seize and making plastic brittle. The net effect making it difficult and often impossible to remove certain plastic fitting without damaging them. However, conventional plastic raised head plug 28 is widely used to plug clean out adapter 42, similar to FIG. 3. Although the threads of said plug 28 are often tight and seized in clean out adapter 42 for reasons mentioned, the heavy gauge of plastic used in its construction and the design of raised head 29, see FIG. 1, make it very durable and easy to remove. For servicing purposes, raised head 29 is the ideal shape to grip with pliers for periodic removal or installation by a lay person or professional. Consequently, raised head 29 of raised head plug 28 has been incorporated into sewer relief valve 40 as float housing 52, for the pressure and water relieving float 54. Utilization of the body of said plug 28 as said float housing 52, relieves the technical difficulty and costly burden of new manufacturing, providing for cost effective and feasible large scale production.

SUMMARY, RAMIFICATIONS, AND SCOPE

Accordingly, the improved sewer relief valve can accomplish its objects and advantages namely: to protect the interior of a structure thus equipped, from damage due to flooding sewage; to be an uncomplicated valve, having an operation that is not only feasible in theory, but has real world possibility for large scale production with low end cost; to provide an uncomplicated and inexpensive valve making protection available to a large population without the need of professional assistance; to ensure that when professional assistance is necessary for maintenance purposes, that access to the sewer system is unhindered because of valve design, or deterioration due to weather and age. An additional advantage is sewer relief valve 40, when installed, has the appearance of commonly accepted and widely used raised head plug 28, requiring no need for change in public preferences. Thus the scope of sewer relief valve 40 should be determined by the appended claims and their legal equivalents, rather than by the examples given.

What is claimed is:

1. A sewer relief valve comprising:

a. A sewage flow riser tube, said riser tube having an open end that is flush with a ground level area;

b. a plug disposed within said riser tube open end for substantially closing said riser tube open end and being flush therewith; said plug having an upstanding wall portion extending above said ground level; said plug having a central passageway extending from said upstanding wall portion to a bottom end of said plug disposed within said riser and below said riser tube open end;

c. a cap means extending across said wall for covering and sealing said central passageway;

d. a float means having a portion disposed within said central passageway and the other portion extending into the riser beneath said plug bottom end, said float means being secured to said cap means and defining a float member, wherein said float member unseals said central passageway by moving said cap means away from said wall, thereby allowing said float member to vertically eject from said central passageway when subjected to a predetermined hydrostatic pressure, in response to a predetermined sewage level within said riser tube.

2. The sewer relief valve of claim 1 wherein said plug comprises a raised head plug body, said body having a vertical exterior surface circumference by male threads.

3. The sewer relief valve of claim 2 wherein said plug comprises a top exterior plane, wherein said raised head comprises four rising walls from said top exterior plane.

4. The sewer relief valve of claim 3 wherein said rising walls are connected at corners defining a square.

5. The sewer relief valve of claim 3 wherein said central passageway passes vertically through said raised head and said exterior plane.

6. The sewer relief valve of claim 1 wherein said cap means comprises a flange portion.

7. The sewer relief valve of claim 6 wherein said flange is conformed to seal and mate with said rising walls of said raised head.

8. The sewer relief valve of claim 1 wherein said float means comprises a polyethylene foam material comprising a rectangular parrallelpiped shape, wherein said float means is attached to a bottom portion of said cap means to maintain and seal said cap across said central passageway.

9. The sewer relief valve of claim 8 wherein said float, removably positioned and substantially sealing said central passageway is retained in said central passageway only by gravitational forces exerted on said float.

10. The sewer relief valve of claim 8 wherein said second body is retained in said central passageway of said first body only by gravitational forces exerted on said second body.

11. A method for assembling a sewage relief valve comprising the steps of:

a. providing a sewage flow riser tube having an open end that is flush with a ground level area;

b. inserting a plug within said riser tube open end for substantially closing said riser tube open end and being flush therewith; said plug having an upstanding wall portion extending above said ground level;

c. providing a central passageway within said plug extending from said upstanding wall portion to a bottom end of said plug disposed within said riser and below said riser tube open end;

d. placing a cap means across said wall for covering and sealing said central passageway;

e. providing a float means having a first portion positioned within said central passageway and a second portion extending into the riser beneath said plug bottom end;

f. attaching a cap means to said float means defining a float member, wherein said float member unseals said central passageway, while allowing said float member to vertically eject from said central passageway when subjected to a predetermined hydrostatic pressure, in response to a predetermined sewage level within said riser tube.

12. The method of claim 11 wherein said float means comprises a polyethylene foam material comprising a rectangular parrallelpiped shape, wherein said float means is attached to a bottom portion of said cap means to maintain said cap across said central passageway.

13. The method of claim 11 further comprising the step of gluing said float means to said cap means.

* * * * *